United States Patent [19]

Ewing

[11] 4,185,805

[45] Jan. 29, 1980

[54] APPARATUS AND METHOD FOR CONSTRUCTING ADJUSTABLE CURVILINEAR CONCRETE FORMS

[75] Inventor: Josh Ewing, San Antonio, Tex.

[73] Assignee: The Burke Company, San Mateo, Calif.

[21] Appl. No.: 916,104

[22] Filed: Jun. 16, 1978

[51] Int. Cl.[2] ..... E04G 17/00

[52] U.S. Cl. ..... 249/210; 249/33; 249/192; 249/194; 249/211; 249/219 R

[58] Field of Search ..... 249/210, 33, 192, 194, 249/211, 219; 52/88

[56] References Cited

U.S. PATENT DOCUMENTS

| | | | |
|---|---|---|---|
| 2,793,720 | 5/1957 | Hawes | 249/210 |
| 2,916,111 | 12/1959 | Pleitgen et al. | 249/210 |
| 2,918,716 | 12/1959 | Pratt | 249/192 |
| 2,971,237 | 2/1961 | Graham | 249/33 |
| 3,016,595 | 1/1962 | Durst | 249/33 |
| 3,618,886 | 11/1971 | Graham | 249/210 |

*Primary Examiner*—William E. Schulz

*Attorney, Agent, or Firm*—Naylor, Neal & Uilkema

[57] ABSTRACT

A form having a selectively adjustable curvilinear surface is provided by securing a flexible connection plate to the rear side of a flexible form panel and clamping the plate to a rigid waler to lock the panel in the desired curvilinear configuration. The connection plate is of angle-shaped cross-sectional configuration with a first flexible leg portion secured in parallel relationship to the flexible panel and a second leg portion disposed in normal relationship to the first portion. The second portion is excised at spaced intervals to accommodate flexing of the first portion and selectively clamped to the rigid waler to lock the first portion against flexing.

11 Claims, 6 Drawing Figures

APPARATUS AND METHOD FOR CONSTRUCTING ADJUSTABLE CURVILINEAR CONCRETE FORMS

BACKGROUND OF THE INVENTION

The present invention relates to an adjustable form for forming curvilinear concrete surfaces and is especially concerned with an improved waler which provides for selective adjustment of a flexible form panel to a desired curvilinear shape. The invention is particularly directed to a reusable form ideally suited for use in gang forming systems.

Curvilinear forms are well known in the prior art. These forms, however, are usually of a fixed non-adjustable curvature. Thus, where the forms are of the reusable type, they are suitable only for repeat forming of concrete sections having the same curvature.

Although adjustable curvilinear forms are known in the prior art, these forms have been of complex construction and have employed adjusting means requiring painstaking incremental adjustment. As a result, such forms have not met with widespread acceptance, particularly in the gang forming art.

SUMMARY OF THE INVENTION

The present invention is concerned with an apparatus and method wherein a flexible waler construction is employed which accommodates select adjustment of the curvilinear shape of a flexible form panel supported thereby and the locking of the panel in the adjusted curvilinear shape. The waler construction incorporates an elongate angle-shaped connector plate which is secured to and extends across the form panel. One leg of the angle shaped connector plate is parallel to the flexible panel and designed to flex therewith during adjustment of the panel to the desired curvilinear shape. The other leg of the angle shaped plate extends generally normal to the panel and is excised at spaced intervals to permit the panel to flex during adjustment. Once in the adjusted condition, said other leg is clamped to lock the form panel in the desired curvilinear configuration.

A principal object of the present invention is to provide an adjustable waler which accommodates curvilinear adjustment of a flexible form panel supported thereby.

Another object is to provide such a waler wherein the principal elements are fabricated out of sheet or plate stock capable of being mass produced by punch forming operations.

Still another object of the invention is to provide such a waler which facilitates flexing of a form panel against a forming template and locking of the panel in the desired configuration without minute incremental adjustments.

A further object of the invention is to provide an adjustable waler ideally suited for use in supporting curvilinear form panels in a gang forming system.

The foregoing and other objects will become more apparent when viewed in the light of the following detailed description and the accompanying drawings.

DESCRIPTION OF THE PREFERRED EMBODIMENT

Figure 1:
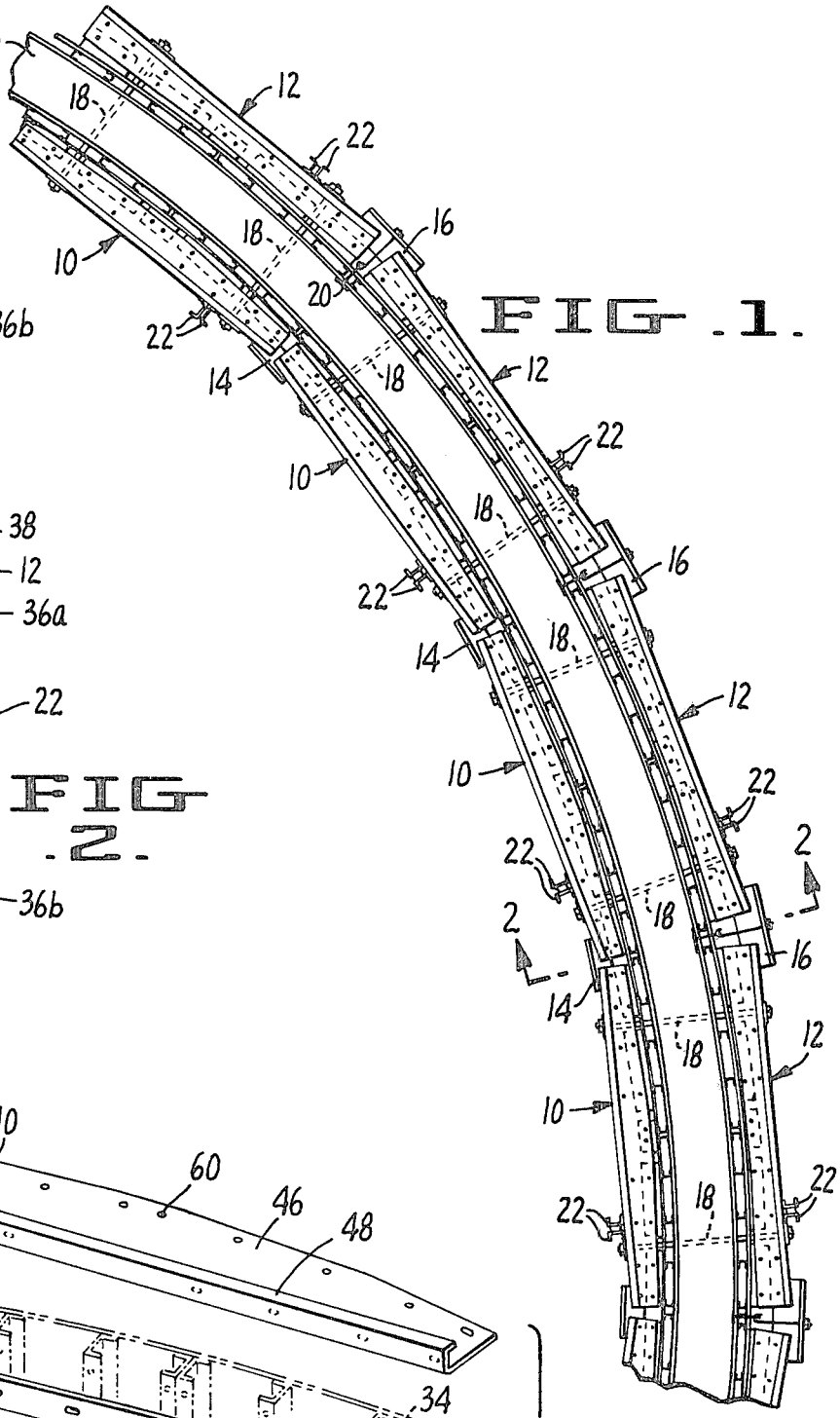
FIG. 1 is a plan view of a gang forming system made up of form panels constructed according to the present invention.

FIG. 1 illustrates a gang forming system comprised of a plurality of adjustable forms constructed according to the present invention. The respective inner forms are identical to one anotner and designated by the numeral 10 and the respective outer forms are identical to one another and designated by the numeral 12. In the assembled condition shown in FIG. 1, the inner forms are connected to one another by splice plates 14 and the outer forms are connected to one another by splice plates 16. Tie rods 18 secure the inner and outer forms in spaced relationship to one another and against separation. Closure panels 20 are secured between the outer forms to close the space therebetween. Double channel aligners 22 are secured to and extend vertically across the outer sides of the inner and outer forms. The aligners serve to secure the stacked forms within a gang forming system in vertical alignment, and may also be used for purposes of attaching plumbing and supporting bracing to the forms.

Figure 2:
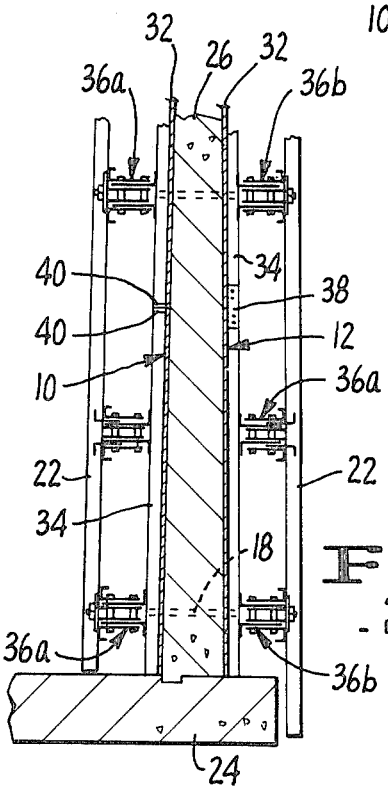
FIG. 2 is a cross-sectional elevational view, with parts thereof broken away, taken on the plane designated by line 2—2 of FIG. 1.

As may be seen from FIG. 2, the wall being formed by the system of FIG. 1 is supported on a preformed foundation 24. The wall being formed between the inner and outer forms is designated by the numeral 26. FIG. 2 also shows that the tie rods 18 extend through the adjustable walers of the present invention and receive nuts 28 engaged with washers 30 bearing against the outside surfaces of the walers. Although not illustrated, it should be understood that the rods 18 also carry stops which engage the inner and outer forms to maintain the forms in spaced relationship. From FIG. 1, it will be appreciated that the tie rods 18 extend normal to the forms, rather than radially with respect to the curved surface being formed.

FIG. 2 also illustrates the basic components of the inner and outer forms, including: flex form panels 32 stiffener channels 34 welded to the outside surfaces of the flex panels; and adjustable waler assemblies **36*a* and 36*b* for the inner and outer forms 10 and 12, respectively. The detailed construction of the forms and the waler assemblies will be described in the subsequent discussion. From that discussion, it will be seen that the assemblies 36*a* and 36*b* are of essentially the same construction, with the exception that the assemblies 36*a* employ convex waler plates to accommodate the radius of the inner form and the assemblies 36*b*** employ concave waler plates to accommodate the radius of the outer forms.

In the gang form condition shown in FIG. 2, the stacked forms are held in vertically aligned condition by the aligners 22 and secured together by panel splice member 38 secured between the stiffener channels of the successive forms. FIG. 2 also shows flat bar attachment plates 40 which extend across the ends of the stiffener channels 34 and may be secured together to hold the stacked forms together.

Figure 3:
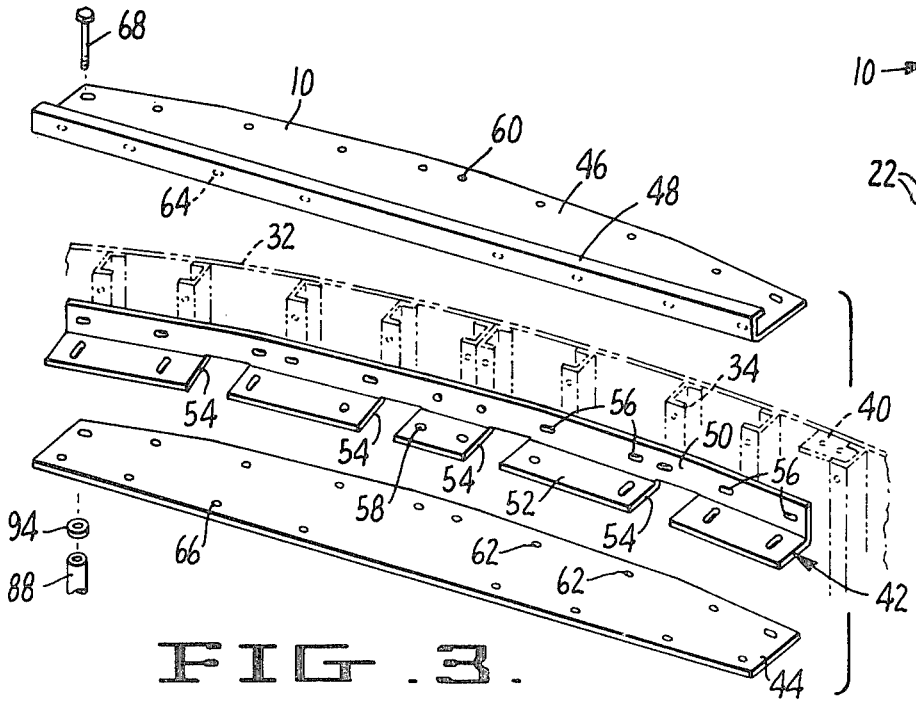
FIG. 3 is an exploded perspective view of the upper section of an adjustable waler constructed according to the present invention.

FIG. 3 illustrates one half of one of the inner form waler assemblies 36*a*. As there shown, the elements of the assembly are exploded for the purpose of illustration and comprise: an angle shaped waler panel connection plate 42; a flat inner waler plate 44; and a flat outer waler plate 46 having a channel shaped reinforcement 48 formed along one edge thereof. In a typical embodiment, the plates 44, 46 and 48 are all formed of 10 gage steel and have a length of 96 inches to accommodate an 8 foot form panel (32). The fabrication of the plates from flat steel stock has the advantage that the plates are ideally suited for mass production by stamping.

The connection plate 42 is typical of all of the connection plates employed in the adjustable walers of the present invention. The construction of this plate may be the same, whether the plate is designed for use in an inside or an outside waler assembly. The plate comprises a first continuous leg portion 50 disposed to be secured against the stiffener channels 34 in parallel relationship to the flex panel 32 and the second leg portion 52 disposed in right angled relationship to the first leg portion. The leg portion 52 is excised at spaced intervals along its length to provide cutouts 54 to accommodate flexing of the first leg portion 50. In a typical embodiment, the cutouts 54 are 3 inches in width and the sections of the portion 52 between the cutouts have a length of from 9 to approximately 24 inches. In the illustrated embodiment, the center section has a length of 9 inches, the sections to either side of the section have a length of $23\frac{1}{2}$ inches, and the outside sections each have a length of 14 inches. With this embodiment, a depth of the first leg portion 50 is approximately $1\frac{7}{8}$ inches and a depth of the second leg portion 52 is approximately $4\frac{1}{2}$ inches.

Horizontally elongated openings 56 are formed in the first leg portion adjacent the stiffener channels 34 to provide for the attachment of fastening clips used to attach the connection plate 42 to the stiffeners. Openings 58 are formed in the leg portion 52 for the receipt of clamping bolts. The openings 58 in the centermost section of the connection plate 42 are round and typically measure approximately 11/16 inches in diameter for a $\frac{5}{8}$ inch clamping bolt. The openings 58 in the sections of the portion 52 to either side of the center section are elongated to permit a clamping bolt received therein to be slid to accommodate flexing of the connection plate and the flex panel secured thereto. Where the clamping bolts are $\frac{5}{8}$ inch in diameter, the openings 58 may be elongated up to approximately 3 inches.

As viewed in plan, the waler plates 44 and 46 have a straight edge at the rear side thereof and a convex edge of the forward side thereof. For a plate 96 inches long, the plate depth as viewed in plan typically varies from a maximum depth of approximately $9\frac{3}{8}$ inches at the center of the plates to a minimum depth of approximately 4 inches at the ends of the plates. The plates 44 and 46 are formed with first openings 60 and 62, respectively, disposed in alignment with one another and the openings 58; and second openings 64 and 66, respectively, disposed in alignment with one another. The openings 60, 62, 64 and 66 are designed to receive clamping bolts 68. In a typical embodiment where the bolts 68 are $\frac{5}{8}$ inch in diameter, the openings 60, 62, 64 and 66 and 11/16 inches in diameter.

Figure 4:
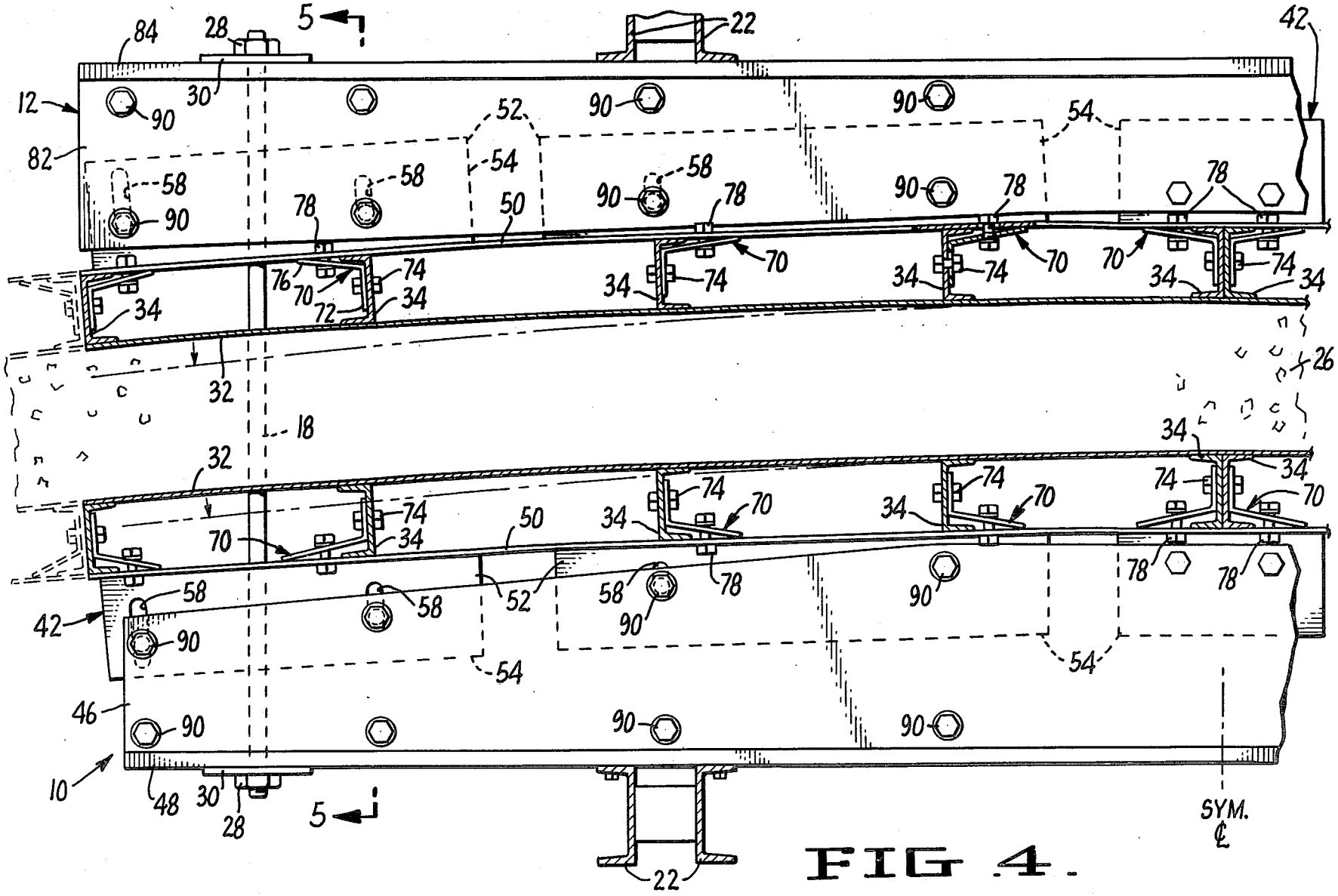
FIG. 4 is a plan view of a section of a gang forming system similar to that shown in FIG. 1, illustrating the detailed construction of the adjustable walers employed in the system.
Figure 5:
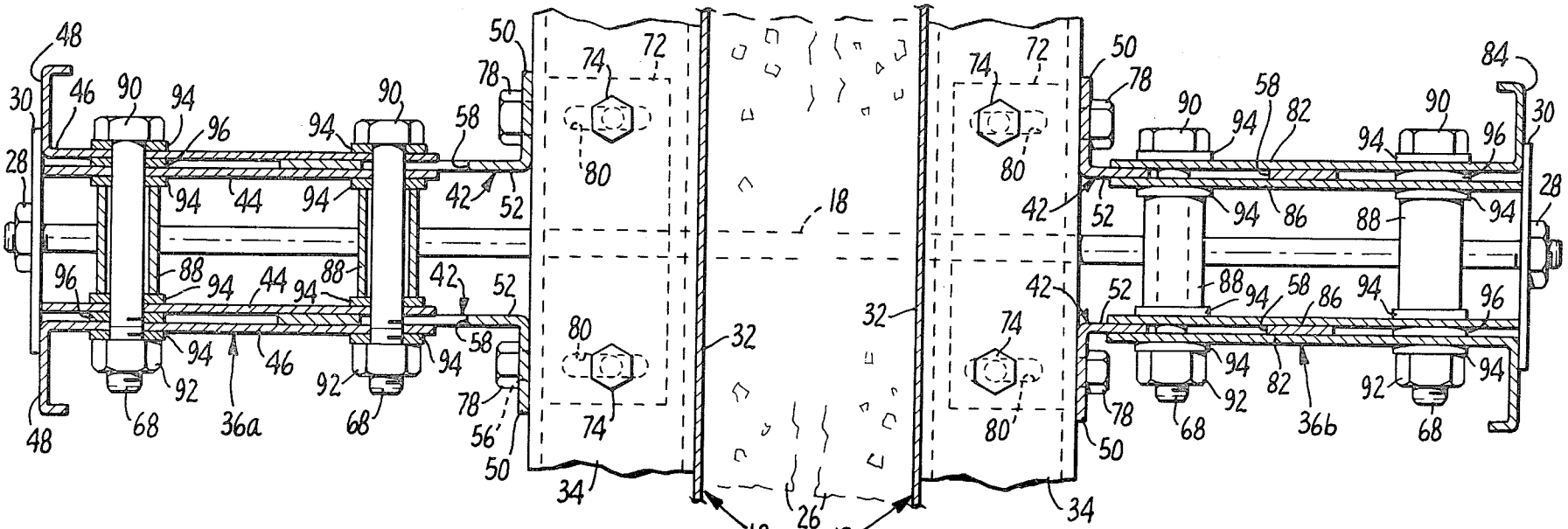
FIG. 5 is a cross-sectional view taken on the plane designated by line 5—5 of FIG. 4; and, FIG. 6 is a plan view, with parts thereof broken away, of a prior art waler which accommodates incremental curvilinear adjustment of a form panel.

The clip structure for fastening the stiffeners 34 to the waler panel connection plates 42 can best be seen from FIGS. 4 and 5. Each clip comprises an angle shaped member 70 having a leg 72 fastened to the web of a stiffener 34 by a bolt 74 and a leg 76 fastened to the first leg portion 50 of the connection plate 42 by a bolt 78. Slotted openings in the legs 72 provide for some adjustment of the bolts 74 relative to the members 70. Bolts 78 extend through the slotted openings 56 in the leg portion 50 and, thus, some slidable movement is provided between the stiffeners 32 and the connection plate 42 to accommodate flexing of the flex form panel 32.

The difference between the shape of the waler plates for the inner form 10 and the outer form 12 can be observed from FIG. 4. There it may be seen that the aforedescribed waler 36 of the inner from has a convex leading edge, as viewed in plan, and that the counterpart waler plate, designated 82 of the outer form has a concave leading edge, as viewed in plan. Other than this difference in shape, the plates 46 and 82 are essentially the same and perform the same function. In a typical example for a flex form panel having a width of 96 inches, the waler plate 82 was fabricated of 10 gage sheet steel having a maximum width of approximately 8 inches and a minimum width (i.e. center) of approximately 5 inches. In this example, the channel shaped reinforcement 84 had a depth of approximately $1\frac{3}{8}$ inches.

Each waler plate 82 has a similarly shaped flat waler plate 86 in apposition thereto. The waler plates 86 are fabricated of the same type of sheet stock as the plates 82 and are of the same configuration, with the exception that they do not include the channel-shaped reinforcements 84 (see FIG. 5).

FIG. 5 shows the waler assemblies 36*a* and 36*b* in fully assembled condition. From this figure, it can be seen that each assembly includes a pair of connection plates 42 disposed in superimposed relationship with the leg portions 50 thereof extending in opposite directions. Each connection plate is sandwiched between a pair of waler plates and the waler plates are clamped to the connection plates by the clamping bolts 68. Cylindrical spacers 88 are received on the bolts between the opposed inner waler plates to maintan said waler plates in spaced condition relative to one another. In a typical example, spacers 88 are 2 inches long and fabricated of $\frac{3}{4}$ inch pipe to accommodate $\frac{5}{8}$ inch bolts 68. The bolts 68 have heads 90 at one end thereof and nuts 92 received on the other ends thereof. Hardened washers 94 are disposed beneath the heads 90 and nuts 92, as well as between the spacers 88 and the waler plates in apposition thereto. Additionally, hardened spacer washers 96 are disposed around the outwardly disposed bolts 68 intermediate each opposed pair of waler plates. The washers 96 have a thickness corresponding to the thickness of the second leg portion 52 of the connection plates and serve to maintain the opposed waler plates in parallel condition when the clamping bolts 68 are tightened.

Operation

In operation, the inner and outer forms are adjusted and secured in adjusted condition prior to being erected. Adjustment is achieved by loosening the clamping bolts 68 and then conforming the flex panel 32 to the desired shape. This is generally accomplished by clamping the form against a template to press the flex panel of the form against the template. Once the form is conformed to the desired shape, the clamping bolts 68 are tightened and the form is removed from the template. In the foregoing example when the bolts are $\frac{5}{8}$ inch in diameter, a clamping torque of from 110 to 130 inch pounds is typical.

Once all of the forms have been conformed to the desired shape and locked in that shape through means of the clamping bolts 68, the composite form may be erected through conventional construction techniques. Erection is generally achieved by first erecting the inner form and then erecting the outer form. During erection, the forms are aligned and plumbed and the tie rods are placed. If there is no change in the shape of successive forms, the forms may be reused without the need of readjustment. Once the job is complete, the forms may be reused for other jobs, and readjusted as necessary.

Prior Art

Figure 6:
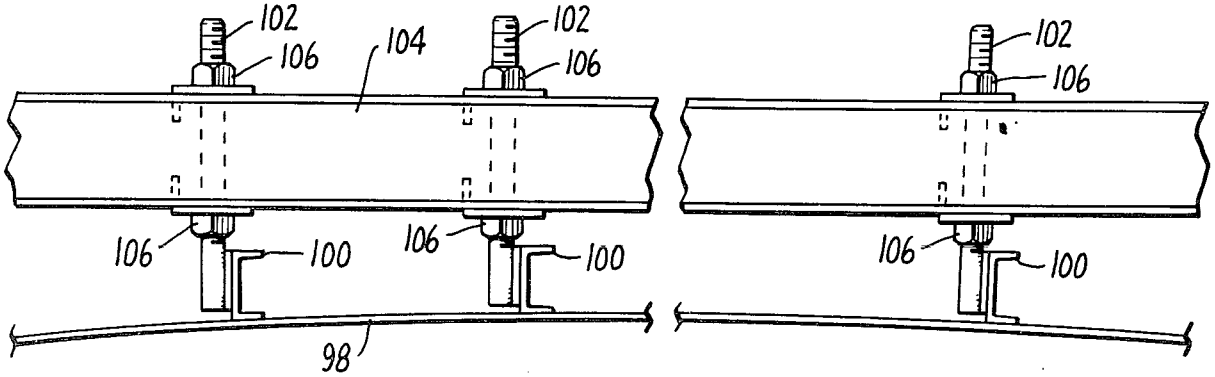
PRIOR ART FIG. 6.

FIG. 6 illustrates a section of a form constructed according to the aforedescribed prior art technique wherein incremental adjustment is necessary. The form of the FIG. 6 employs a flex form panel 98 and stiffeners 100 corresponding, generally, to the flex form panels 32 and stiffeners 34 of the present invention. In the case of the FIG. 6 arrangement, however, the stiffeners are not secured to flexible panel connection plates. Rather, adjustment is provided through means of bolts 102 fixed to the stiffeners 100 and extending therefrom to adjustable connection with a rigid waler 104. Adjustable connection to the rigid waler 104 is provided by nuts 106 threadably received on the bolts 102 to either side of the waler. Through select adjustment of the nuts 106 on the bolts 102, the bolts can be extended or retracted to adjust the curvilinear shape of the flex panel 32.

The waler of FIG. 6 is generally adjusted by incrementally adjusting the respective adjustment bolts without the employment of a template. As a result, the waler is not nearly as well suited for rapid adjustment of multiple forms as is the form of the present invention. The FIG. 6 form also is not suited for mass production by simple stamping techniques, as is the form of the present invention.

Conclusion

From the foregoing description, it is believed apparent that the present invention enables the attainment of the objects initially set forth herein. In particular, an improved concrete forming panel is provided which is relatively inexpensive to fabricate, reusable, quickly and easily adjustable to different curvilinear shapes, and ideally suited for use in gang forming operations. Secure clamping in the adjusted condition is provided by a high friction clamping arrangement wherein the connection plates are securely clamped between opposed clamping surfaces. It should be understood, however, that the invention is not intended to be limited to the specifics of the aforedescribed embodiment, but rather as defined by the accompanying claims.

I claim:

1. An adjustable waler for concrete forms, said waler comprising: an elongate angle-shaped waler panel connection plate having a first leg portion disposed for parallel attachment to a flex panel and a second leg portion disposed in right angled relationship to the first portion, said second leg portion being excised at spaced intervals to permit the first leg portion to be flexed; a pair of waler plates disposed in juxtaposition to either side of the second leg portion; and, clamping means to clamp the second leg portion between the whaler plates to selectively secure the first leg portion in an adjusted flexed condition.

2. An adjustable waler according to claim 1 wherein at least one of the waler plates is of angle-shaped cross-section with one leg thereof juxtaposed to the second leg portion of the connection plate and the other leg thereof extending in generally right angled relationship to said portion.

3. An adjustable waler according to claim 1 wherein the clamping means comprises: a first opening formed in the second leg portion of the connection plate; second openings formed in the waler plates in alignment with one another and said first opening; a bolt extending through said first and second aligned openings and having a head disposed to the outside of one of the waler plates and a nut threadably received on the bolt to the outside of the other of the waler plates; and wherein at least certain of said openings are larger than the bolt to accommodate slidable movement of the second leg portion of the connection plate relative to the waler plates.

4. An adjustable waler for concrete forms, said waler comprising: a pair of elongate angle-shaped waler panel connection plates, said plates each having a first leg portion disposed for parallel attachment to a flex panel and a second leg portion disposed in right angled relationship to the first portion thereof, said second leg portions being excised at spaced intervals to permit the first leg portions to be flexed; a pair of waler plates disposed in juxtaposition to either side of the second leg portions of each of the connection plates; and clamping means to clamp the waler plates against the second leg portions to selectively secure the first leg portions in an adjusted flexed condition.

5. An adjustable waler according to claim 4 wherein at least one of the waler plates is of angle-shaped cross-section with one leg thereof juxtaposed to one of the second leg portions and the other leg thereof extending in generally right angled relationship to said portion.

6. An adjustable waler according to claim 4 wherein the clamping means comprises: first openings formed in the second leg portions of the connection plates; second openings formed in the waler plates in alignment with one another and said first openings; a bolt extending through said first and second aligned openings and having plate engaging means thereon for engagement with the outside waler plates to selectively clamp the waler plates against the second leg portions of the connection plates; and wherein at least certain of said openings are larger than the bolt to accommodate slidable movement of the second leg portions relative to the waler plates.

7. An adjustable waler according to claim 4 wherein: the second leg portions of the connection plates are disposed in spaced parallel relationship to one another; and spacer means are provided to maintain the waler plates for the respective second leg portions of the connection plates in spaced parallel relationship.

8. An adjustable form for the forming of curved concrete surfaces, said form comprising: a flexible form panel; stiffener members fixed to and extending along the inside of said panel in spaced parallel relationship to one another, flexible connection plates extending across said stiffener members in generally normal relationship thereto; means securing the connection plates to the stiffener members for slidable movement relative thereto to accommodate flexing of the flexible panel; rigid waler members disposed in parallel slidable engagement with the connection plates; and, clamping means to clamp the connection plates to the waler members to selectively secure the connection plates in an adjusted flexed condition.

9. An adjustable form according to claim 8 wherein said connection plates each comprise an elongate angle-shaped member having a first leg portion extending parallel to the flexible form panel and a second leg portion disposed in right angled relationship to the first portion, said second leg portion being excised at spaced intervals to permit the first leg portion to be flexed.

10. An adjustable form according to claim 9 wherein the clamping means comprises: first openings formed in the second leg portions of the connection plates; second openings formed in the waler members in alignment with the first openings; bolts extending through said aligned first and second openings and having means thereon for selectively clamping the second leg portions against the waler members; and wherein at least certain of said openings are larger than the bolts to accommodate slidable movement of the second leg portions relative to the waler members.

11. A method of providing a curvilinear form surface, siad method comprising: bending a flexible form panel to the curvilinear shape desired; extending flexible connectors across the rear side of the form panel at spaced intervals and securing the connectors against separation from the form panel; and, clamping the connectors to rigid walers to maintain the flexible form panel in the desired curvilinear shape.

* * * * *